United States Patent [19]

Cockeram et al.

[11] 4,454,009

[45] Jun. 12, 1984

[54] METHOD OF, AND A MACHINE FOR, ELECTROPLATING

[75] Inventors: John M. Cockeram, Spratton, England; Herbert Wurmb, Nieder, Austria

[73] Assignee: S.G. Owen Limited, Northampton, England

[21] Appl. No.: 495,160

[22] Filed: May 17, 1983

[51] Int. Cl.[3] ..... C25D 5/02; C25D 17/06

[52] U.S. Cl. ..... 204/15; 204/224 R

[58] Field of Search ..... 204/15, 297 W

[56] References Cited

U.S. PATENT DOCUMENTS 2,861,936 11/1958 Colasanto ..... 204/297 W
3,658,663 4/1972 Fukanuma ..... 204/297 W
4,043,894 8/1977 Gibbs ..... 204/297 W
4,302,316 11/1981 Nester ..... 204/297 W

*Primary Examiner*—T. M. Tufariello
*Attorney, Agent, or Firm*—Spencer & Frank

[57] ABSTRACT

There is provided, in a method of selective electroplating, the improvement comprising the utilization of a highly conductive electrolyte, compatible with the plating electrolyte but containing no depositable metallic ions, to form the cathode connection to the components to be plated and, in a machine for electroplating components, the improvement comprising providing the cathode connection to the components to be plated through the intermediary of a highly conductive electrolyte compatible with the plating electrolyte but containing no depositable metallic ions.

6 Claims, 2 Drawing Figures

METHOD OF, AND A MACHINE FOR, ELECTROPLATING

BACKGROUND OF THE INVENTION

The present invention relates to a method of, and a machine for, electroplating, particularly, but not exclusively, for the plating of headers, utilising an electrolyte to effect the cathodic connection and, in the case of the plating of headers, to form a connection between those leads which are insulated from one another.

SUMMARY OF THE INVENTION

According to a first aspect of the present invention, there is provided in a method of selective electroplating, the improvement comprising the utilisation of a highly conductive electrolyte, compatible with the plating electrolyte but containing no depositable metallic ions, to form the cathode connection to the components to be plated.

In a preferred configuration, the invention comprises a method of selectively electroplating components, which comprises mounting the components in a worktray, placing the worktray over a chamber containing or intended to contain highly conductive electrolyte, compatible with the plating electrolyte but containing no depositable metallic ions, placing the inverted worktray in a plating machine (in the case of a jet plating machine, so that the jet anodes of the plating machine align with parts of the components exposed below the inverted worktray,) and electroplating the said components, the cathode connection to the said components being effected through highly conductive electrolyte, compatible with the plating electrolyte but containing no depositable metallic ions, in the chamber on the opposite side of the worktray from the jet plating anodes. Advantageously, the chamber comprises a two-part chamber, the lower part of the chamber containing the highly conductive electrolyte during electroplating, the part of the chamber which is uppermost during electroplating being sufficiently large as to contain all the highly conductive electrolyte on inverting the worktray and chamber from the jet electroplating machine.

In the plating of components such as headers, not only must one keep the highly conductive electrolyte, that is the "contacting" electrolyte, separate from the plating electrolyte, but also one must retain the headers in place in their mask against the thrust of the plating electrolyte through a standard jet, which probably operates at about 10 p.s.i. Accordingly, it is preferred that the chamber be pressurised during electroplating, to keep the highly conductive electrolyte separate from the plating electrolyte and also to assist the retention of the components being plated in their mask against the thrust of the plating electrolyte, during electroplating. Advantageously, the pressurisation is effected by introducing air under pressure to an expansible portion of the chamber, separated from the highly conductive electrolyte by a diaphragm.

It will be seen that by applying pressure to the assembly during the plating cycle, the members being plated can more readily be maintained in place against their mask against the thrust of the plating electrolyte. In addition, if a lip seal is used in the assembly, the seal will become tighter as pressure is increased. To avoid accidental contamination of the plating electrolyte by the highly conductive electrolyte, the highly conductive electrolyte should have a similar or compatible formulation to the plating electrolyte but, of course, without any depositable metallic ions therein, such as gold, silver or the like.

According to a second aspect of the present invention, there is provided in a machine for electroplating components, the improvement comprising providing the cathode connection to the components to be plated through the intermediary of a highly conductive electrolyte, compatible with the plating electrolyte but containing no depositable metallic ions.

It will be naturally appreciated that with the present invention, it is possible to plate headers with straight leads, coned leads, bent leads and leads of different lengths.

DESCRIPTION OF PREFERRED EMBODIMENTS

Figure 1:
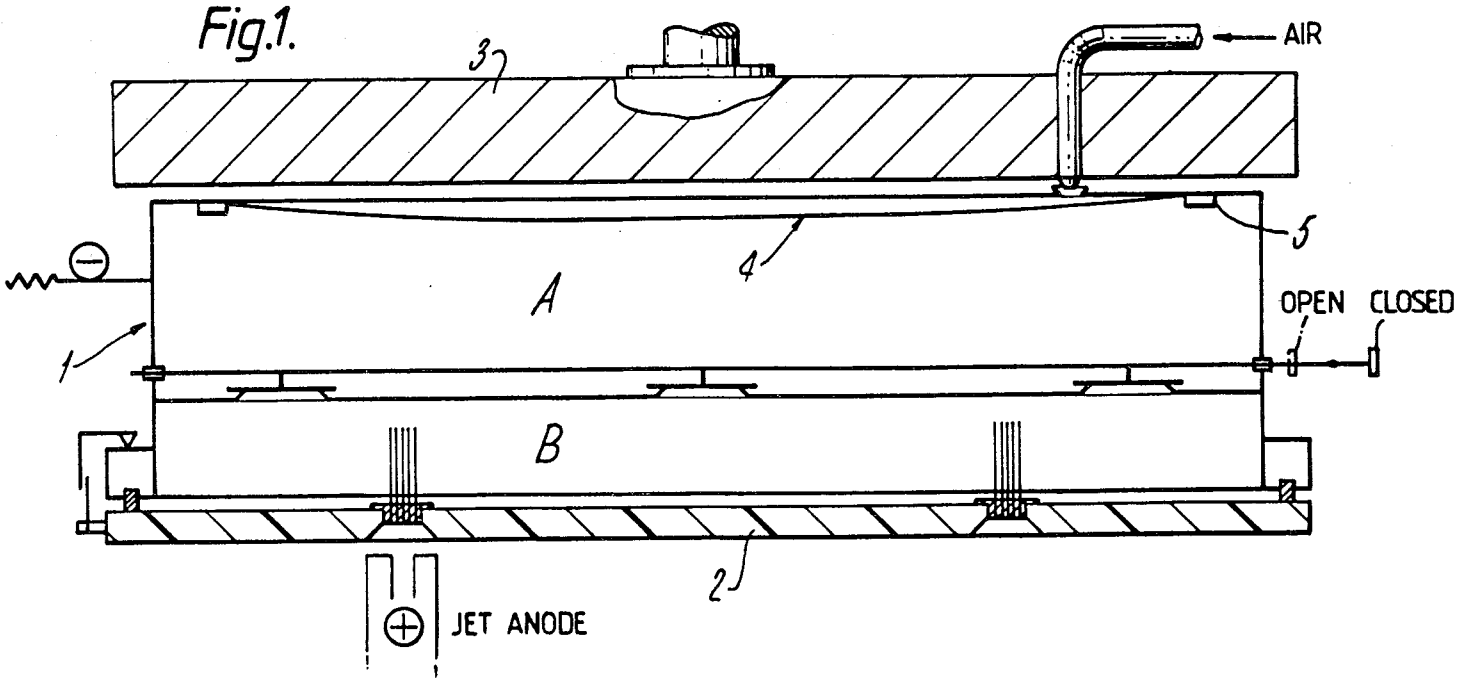
FIG. 1 shows a diagrammatic cross-sectional view of a plating system in accordance with the present invention.
Figure 2:
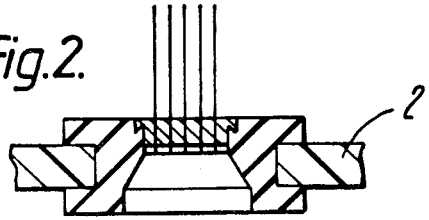
FIG. 2 shows a diagrammatical sectional view of a typical rubber mask insert in the worktray, retaining a header to be plated.

The main part of the plating machine naturally comprises a standard plating machine, such as a "Carousel" made by S. G. Owen Limited. Between the worktray, made of plastics material, and the plating machine pressure plate, is provided a chamber construction sealed to the back of the worktray, for containing the highly conductive electrolyte.

The chamber 1 between the worktray 2 and the pressure plate 3 is preferably made of a material such as stainless steel and is sealed to the back of the worktray 2 about the periphery thereof, preferably by means of quick releasable clamps. The chamber 1 is typically divided into two compartments A and B, separated by a partition provided with valves which can be opened and closed to allow the passage of fluid from compartment A to compartment B and vice versa. On the side of the chamber 1 remote from the worktray 2 is provided a diaphragm 4 mounted to the wall of the chamber 1 by a clamp ring 5, means being provided whereby pressurised air can be introduced into the space between the wall of the chamber 1 and the diaphragm 4.

Describing a specific method of performing the invention, components, in this case headers, by way of example, are placed upright in a worktray by means of a standard Wurmbs vibrator table, headers of the TO 18 type can be loaded at a rate of 225 per minute and of TO 5 type at 85 per minute. These are either then loaded directly or into Lindberg, Eset or similar tapes which are then placed in the worktray. Mask rubbers having a lip seal which seat between the sides and under the top flange of the header cap are provided, so that a small downward pressure on the header increases the effectiveness of the seal.

When the worktray is fully loaded, the chamber 1 is clamped over the worktray and a highly conductive electrolyte compatible with the plating electrolyte but containing no depositable metallic ions is introduced into the volume of the chamber under fairly low pressure. This pressure ensures good sealing between the header and the mask. Cathode contact is made with the chamber 1, which is transferred via the electrolyte to the pins and cap of each header. Contamination of the plating electrolyte is avoided by compatibility of the highly conductive electrolyte with the plating electrolyte, should any slight leak occur. The contact/mask is used to plate selectively the headers in the usual way.

As described above, to avoid pumping the electrolyte to and from the chamber, the chamber can, as described by way of example with reference to the drawing, be divided into two compartments by means of a divider. This is positioned above and a little higher than the top ends of the leads of any headers to be plated. The volume of the upper compartment is larger than the volume of the lower compartment and in the divider are several fairly large holes which can be opened or closed by an external linked operating device. With the holes closed, electrolyte will not be able to pass from the upper to the lower compartment. In the top part of the chamber is provided a flexible membrane (diaphragm) made of reinforced neoprene or similar material. This is sealed by the edges thereof to the underside of the top of the chamber, which has a hole at a convenient location through which air under pressure can enter between the top of the chamber and the membrane. Such compressed air will deflect the membrane into the upper compartment and, when the valves are open, will apply a downwardly directed thrust onto the headers to effect a seal against their individual masks.

An exemplary method of operating the above described device will now be set out.

Firstly, the chamber is inverted and the valves opened. Electrolyte is then introduced into the chamber, in an amount sufficient to cover the header lead ends in chamber B when the box is in its normal operating position. After the electrolyte has flowed into the chamber A, the valves are closed.

The chamber is next turned over and placed on a loaded worktray and secured thereto by quick-release clamps. This is then placed into the plating head of a plating machine and the plating machine pressure plate is lowered and an air nozzle aligned with the air hole in the chamber. The valves are then opened to allow electrolyte to flow into chamber B and air introduced into the volume above the diaphragm. Thereafter, plating is performed in the usual manner.

After plating, the pressurised air is turned off and the chamber and worktray removed from the plating machine. This assembly is then inverted to allow electrolyte to return to chamber A and, thereafter, the valves are closed. The chamber is then removed from the worktray and any headers that have fallen into chamber B can be removed. The plating sequence is then repeated.

As regards possible formulations for the conductive electrolyte, these will typically be aqueous solutions of phosphates and/or citrates as used as conductive salts in proprietary plating solutions for pure/hard gold plating. The relevant conductivities are as follows:

| | Conductivity at 100 g/l (milli-siemens per cm) |
|---|---|
| citric acid | 6.1 |
| tri-sodium citrate | 40 |
| ammonium citrate | — |
| potassium dihydrogen phosphate | 42 |
| potassium pyrophosphate | — |

Mixtures of solutions such as above would need to be tailored to the composition of the plating solution and characteristics of the electrolyte concerned. Exemplary concentrations of electrolytes would be in the region of 5 to 1000 grams per liter, with 100 to 200 grams per liter being generally preferred.

Although particular embodiments of the invention have been described and illustrated herein, it is recognised that modifications may readily occur to those skilled in the art and consequently it is intended that the following claims be interpreted to cover such modifications and equivalents.

What is claimed is:

1. In a method of selective electroplating, the improvement comprising the utilisation of a highly conductive electrolyte, compatible with the plating electrolyte but containing no depositable metallic ions, to form the cathode connection to the components to be plated, said improvement comprising mounting the components in a worktray, placing the worktray over a chamber containing or intended to contain the said highly conductive electrolyte, placing the inverted worktray in a plating machine and electroplating the said components, the cathode connection to the said components being effected through the said highly conductive electrolyte in the chamber on the opposite side of the worktray from the plating anodes of the plating machine; said chamber comprising a two-part chamber, the lower part of the chamber containing the highly conductive electrolyte during electroplating, the part of the chamber which is uppermost during electroplating being sufficiently large as to contain all the highly conductive electrolyte on inverting the worktray and chamber from the electroplating machine.

2. The improvement of claim 1, wherein the chamber is pressurised during electroplating, to keep the highly conductive electrolyte separate from the plating electrolyte and also to assist the retention of the components being plated in place against the thrust of the plating electrolyte, during electroplating.

3. The improvement of claim 2, wherein the pressurisation is effected by introducing air under pressure into an expansible portion of the chamber, which expansible portion is separated from the highly conductive electrolyte by a diaphragm or a piston.

4. In a machine for electroplating components, the improvement comprising providing the cathode connection to the components to be plated through the intermediary of a highly conductive electrolyte, compatible with the plating electrolyte but containing no depositable metallic ions, providing means for mounting the components in a worktray, a chamber over which the worktray can be placed, which chamber contains or is intended to contain the said highly conductive electrolyte, and a plating machine in which the inverted worktray can be placed, whereby the said components can be electroplated, the cathode connection to the said components being effected through the said highly conductive electrolyte in the chamber on the opposite side of the worktray from the plating anodes of the plating machine, the chamber comprising a two-part chamber, the lower part of the chamber containing or intended to contain the highly conductive electrolyte during electroplating, the part of the chamber which is uppermost during electroplating being sufficiently large as to contain all the highly conductive electrolyte on inverting the worktray and chamber from the electroplating machine.

5. The improvement of claim 4, wherein means are provided to pressurise the chamber during electroplating, to keep the highly cnductive electrolyte separate from the plating electrolyte and also to assist the retention of the components being plated in place against the thrust of the plating electrolyte, during electroplating.

6. The improvement of claim 5, wherein means are provided whereby the pressurisation can be effected by introducing air under pressure into an expansible portion of the chamber, which expansible portion is separated from the highly conductive electrolyte by a diaphragm or a piston.

* * * * *